US008070561B2

(12) United States Patent
Liffers et al.

(10) Patent No.: US 8,070,561 B2
(45) Date of Patent: Dec. 6, 2011

(54) HEIGHT ADJUSTABLE DRIVE ARRANGEMENT FOR A FLOOR CARE MACHINE

(75) Inventors: Achim Liffers, Velbert (DE); Bernd Falkenstein, Wuppertal (DE)

(73) Assignee: Stein & Co. GmbH, Velbert (DE)

( * ) Notice: Subject to any disclaimer, the term of this patent is extended or adjusted under 35 U.S.C. 154(b) by 924 days.

(21) Appl. No.: 12/079,463

(22) Filed: Mar. 26, 2008

(65) Prior Publication Data

US 2008/0268758 A1 Oct. 30, 2008

(30) Foreign Application Priority Data

Apr. 27, 2007 (DE) ..... 10 2007 019 947

(51) Int. Cl.
*B24B 27/08* (2006.01)

(52) U.S. Cl. ..... 451/353; 451/350; 451/352; 451/360

(58) Field of Classification Search ..... 15/49.1, 15/50.1, 87, 98, 385; 451/350, 352, 363, 451/360

See application file for complete search history.

(56) References Cited

U.S. PATENT DOCUMENTS

| | | | | |
|---|---|---|---|---|
| 4,122,576 | A | 10/1978 | Bevington et al. | |
| 4,731,895 | A | 3/1988 | Zack et al. | |
| 4,742,652 | A | 5/1988 | Cannan et al. | |
| 5,056,175 | A | 10/1991 | Stein et al. | |
| 5,127,124 | A | 7/1992 | Palmer et al. | |
| 5,255,410 | A | 10/1993 | Stein et al. | |
| 5,593,340 | A * | 1/1997 | Nelson et al. | 451/42 |
| 5,615,437 | A | 4/1997 | Takahashi et al. | |
| 5,700,187 | A * | 12/1997 | Balbi | 451/495 |
| 6,308,360 | B1 | 10/2001 | Stein | |
| 6,685,547 | B2 * | 2/2004 | Boman | 451/495 |
| 7,553,221 | B2 * | 6/2009 | Hope et al. | 451/495 |

FOREIGN PATENT DOCUMENTS

DE 198 57 628 6/2000

* cited by examiner

*Primary Examiner* — Timothy V Eley
(74) *Attorney, Agent, or Firm* — W. F. Fasse; W. G. Fasse

(57) ABSTRACT

A floor care machine such as a floor polisher includes a machine frame carrying a motor coupled through a drive arrangement to a rotationally driven head on which a floor care disc such as a polishing pad is mounted. The drive arrangement includes a drive element rotationally driven by the motor, and a driven element that is connected to the driven head and is automatically height adjustable. The drive element includes a bearing hub, an outer ring and four uniformly rotationally offset spokes that carry first rolling guides extending along helical paths about the rotation axis. The driven element includes upper and lower partial elements that receive the spokes therebetween and carry second rolling guides arranged facing the first rolling guides along the helical paths, and roller bodies are interposed therebetween. Relative rotation between the drive element and the driven element causes an axial height adjustment of the driven head.

19 Claims, 8 Drawing Sheets

HEIGHT ADJUSTABLE DRIVE ARRANGEMENT FOR A FLOOR CARE MACHINE

PRIORITY CLAIM

This application is based on and claims the priority under 35 U.S.C. §119 of German Patent Application 10 2007 019 947.5, filed on Apr. 27, 2007, the entire disclosure of which is incorporated herein by reference.

FIELD OF THE INVENTION

The invention relates to a floor care machine, such as a floor polishing machine, with a rotatably drivable floor care disc such as a floor polishing pad. The height of the floor care disc is adjustable so as to adjust the pressing force or contact pressure of the floor care disc on the floor, depending on the floor characteristics.

BACKGROUND INFORMATION

Floor care machines, such as floor polishing machines, having a rotatably drivable floor care disc are known in the art. Such a conventional floor care machine typically has a machine frame or chassis carrying a drive motor and a drive arrangement that couples the drive motor to the floor care disc, so as to rotationally drive the floor care disc about a vertical rotation axis. The known floor care machine also includes guide and support elements such as rollers or wheels that support the machine on the floor in a movable or rollable manner. It is also known to construct the drive arrangement so that it permits a height adjustment of the floor care disc relative to the floor and relative to the guide wheels or rollers, so as to adjust the contact pressure or pressing force of the floor care disc on the floor.

A conventional floor care machine of the above described general type is known from the German Patent Publication DE 198 57 628 and the counterpart U.S. Pat. No. 6,308,360, the entire disclosure of which is incorporated herein by reference. Such a known floor care machine has a drive arrangement that enables the height of the floor care disc or pad relative to the floor surface to be adjusted automatically depending on the floor characteristics, in order to avoid damaging the floor surface. The height adjustment is carried out automatically dependent on the applied drive torque. Thus, the torque regulating height adjustment also ensures a continuous operation without overloading the drive. While the known machine according to the above mentioned patents is effective for its intended objects and purposes, it is desired to still further improve the adjustable drive arrangement in terms of a robust durable mechanism that has low maintenance and repair requirements for a long operating life, even in heavy duty commercial applications for such floor care machines. Particularly, it has been found that either the transmission elements of the height adjustable drive arrangement necessary for an automatic height adjustment are not durable or robust enough, or it is difficult to construct the adjusting mechanism in such a manner to achieve a wear-free embodiment with a simple assembly and durable operation. Thus, the present invention further develops and improves the drive arrangement known from the above mentioned patents, the entire disclosures of which are incorporated herein by reference. The present application will further disclose certain modifications, replacements, and additions to the components and features disclosed in the prior patents.

SUMMARY OF THE INVENTION

In view of the above, it is an object of the invention to provide a floor care machine of the above discussed general type, with a robust design and construction, so as to achieve an automatic height adjustment of the floor care disc or pad in a simple manner. The invention further aims to achieve a play compensation, and to minimize the number of components of the drive arrangement, while also achieving a simple assembly thereof. The invention further aims to avoid or overcome the disadvantages of the prior art, and to achieve additional advantages, as apparent from the present specification. The attainment of these objects is, however, not a required limitation of the claimed invention.

The above objects have been achieved according to the invention in a floor care machine, including a machine frame or chassis, a drive motor mounted on the machine frame, a driven head that is rotatably carried by the machine frame to be rotatable about a substantially vertical rotation axis and that is adapted to carry a floor care disc or pad, a drive transmission and a drive arrangement that couple the drive motor to the driven head, and support elements that are adapted to support the machine frame on the floor so as to be movable along the floor. The drive arrangement enables an axial height adjustment of the driven head relative to the machine frame and the support elements, so as to enable an adjustment of the contact pressure or pressing force of the floor care disc or pad on the floor, dependent on the floor characteristics.

The drive arrangement includes a drive element that is rotationally coupled to the drive motor and is rotatably supported to be rotatable about the rotation axis of the driven head and the floor care disc. The drive arrangement further includes a driven element connected to the driven head for the floor care disc. The driven element and the drive element are axially and rotationally displaceable or shiftable relative to one another on the rotation axis, such that a relative rotation of the drive element and the driven element is coupled or associated with a relative axial displacement thereof so as to achieve a height adjustment of the driven element and therewith of the driven head for the floor care disc. That adjustment preferably occurs responsive to and dependent on the torque applied by the drive motor to the drive element relative to the driven element, which is subjected to a working drag or resistance to rotation by the floor care disc rotating against the floor surface.

The drive arrangement of the inventive machine especially preferably has the following features. The drive element comprises a central bearing hub, an annular outer ring, and a connection arrangement that includes at least four uniformly rotationally or circumferentially offset spoke elements that extend between and interconnect the bearing hub and the outer ring. The outer ring is preferably provided with a drive connection for an operative drive coupling with the drive motor, for example a ring gear or gear rim, or alternatively a belt pulley sheave or the like on the outer ring, which engages a transmission component such as a drive V-belt, or a drive gear belt or toothed belt, or a gear wheel, or the like, transmitting drive power from the motor. The spoke elements each respectively carry a first rolling guide that respectively extends along a partial helical path about the rotation axis. The driven element carries second rolling guides that are arranged corresponding to and mutually facing the first rolling guides of the spoke elements to form pairs therewith. Thus, each second rolling guide also extends along the same partial helical path respectively as the associated or paired first rolling guide of the drive element. The drive arrangement further comprises roller bodies such as ball bearings or roller bearings that are configured and fitted to roll along the rolling guides, and are respectively inserted between the cooperating pairs of the first and second rolling guides.

Preferably, the successive first rolling guides of successive rotationally adjacent spoke elements respectively have successively alternating or reversed orientations. For example, a given first rolling guide faces axially upwardly and rotationally clockwise about the rotation axis, and the first rolling guide of the next rotationally adjacent spoke element faces axially downwardly and rotationally counterclockwise relative to the rotation axis.

Further preferably, the driven element comprises two partial elements respectively arranged on opposite axial sides of the drive element and particularly on opposite sides of the spoke elements of the drive element. Namely, the spoke elements are received between the two partial elements of the driven element.

Still further preferably, a spring bears upon and axially and/or rotationally biases the driven element so as to tend to push the driven element outwardly or downwardly toward the floor, namely so as to tend to push the driven head and the floor care disc downwardly toward the floor.

With the inventive construction of the drive arrangement, it is possible to use a relatively small number or set of similar parts that can be easily assembled, and that furthermore achieve a trouble-free operation. Furthermore, the inventive drive arrangement provides a self-blocking Cardanic or universal joint that establishes a flexible rotational suspension of the driven head and the floor care disc, with a continuous durable freedom from play, while allowing an angular deflection or "bending" of the rotation axis away from a straight line. Furthermore, with the inventive construction and arrangement of the components, the force transmission through the rolling bodies will be oriented perpendicularly to the helical path of the rolling guides. Appropriate selection of the helical slope angle ensures the proper distribution of the transmitted forces between an axial force component and a rotational force component.

In order to achieve a compensation of play in the drive arrangement, the two partial elements of the driven element arranged on opposite sides of the spoke elements of the drive element are coupled to one another in a yielding manner by securing elements such as screws or bolts with springs interposed thereon. Thus, these springs allow a slight spring-loaded yielding between the two partial elements of the driven element, so as to compensate any play between the spoke elements and the partial elements of the driven element through the rolling guides and the roller bodies. It is further preferable, that the securing elements and the spring elements are arranged tilted in a direction dependent on the rolling body forces acting on the rolling guides. Particularly, the angle of the securing elements with the spring elements is selected corresponding to the rolling body forces acting on the rolling guides, to achieve the most effective play compensation.

According to a further advantageous embodiment feature, the rolling guides are fabricated of wear-resistant sintered material, as independent components that are inserted into corresponding receiver recesses in the spoke elements and/or in the partial elements of the driven element. Alternatively, the rolling guides can simply be grooves machined into the spoke elements and the partial elements of the drive element, but it is preferred to embody the rolling guides as removable and replaceable components that can be exchanged for maintenance and repair. An especially simple and advantageous construction is achieved by configuring all of the rolling guides identically as the same identically configured parts for both the drive element and the driven element.

According to another preferred feature of the invention, the arrangement further comprises an axially and rotationally movable seal arranged between the driven element and the drive element.

BRIEF DESCRIPTION OF THE DRAWINGS

In order that the invention may be clearly understood, it will now be described in connection with an example embodiment, schematically illustrated in the accompanying drawings, wherein.

Figure 1:
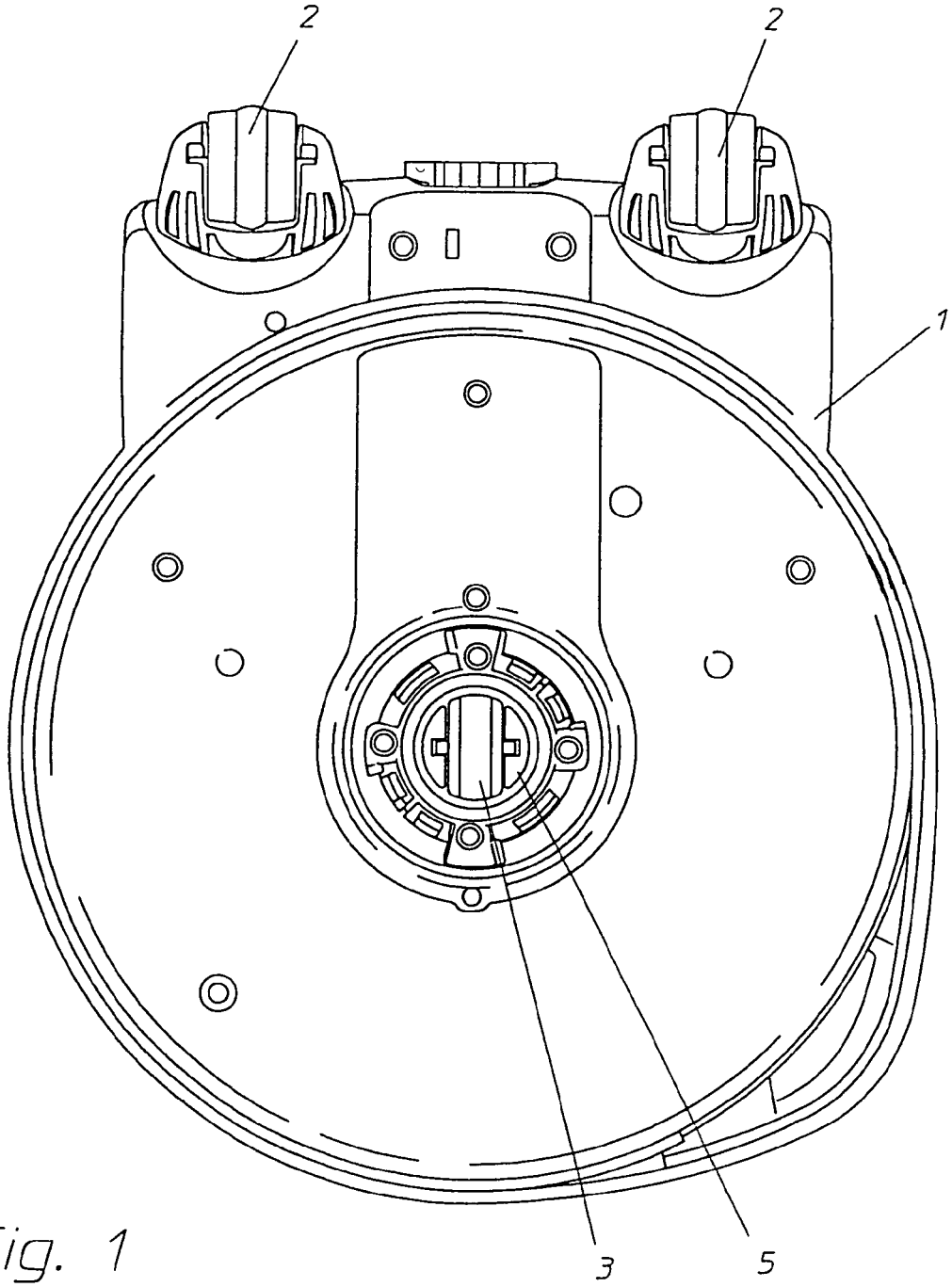
FIG. 1 shows a bottom plan view of the underside of a floor care machine, partially as a ghost view, according to the present invention.
Figure 2:
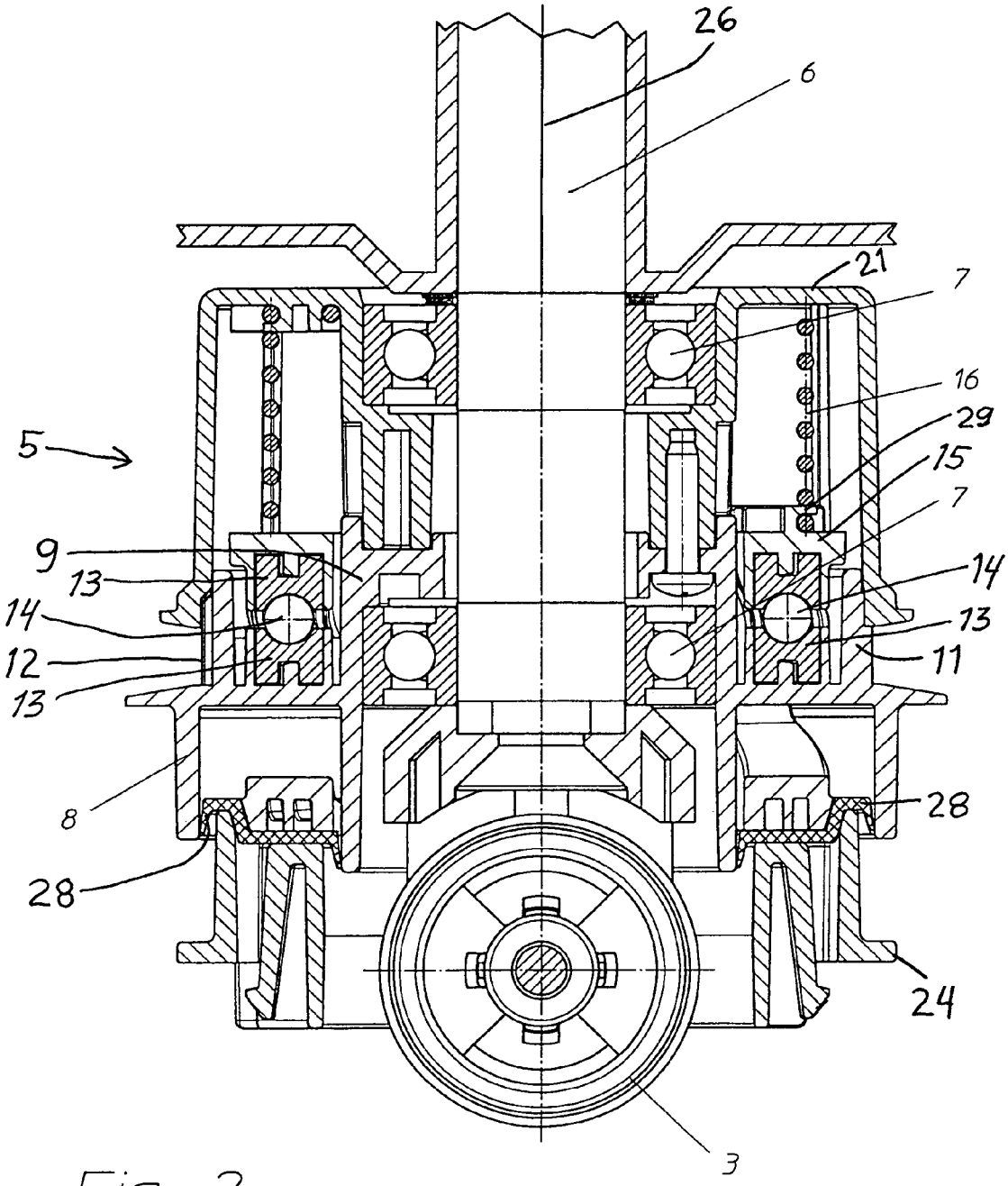
FIG. 2 shows a vertical section through an embodiment of a height adjustable drive arrangement for a floor care machine according to the invention.
Figure 3:
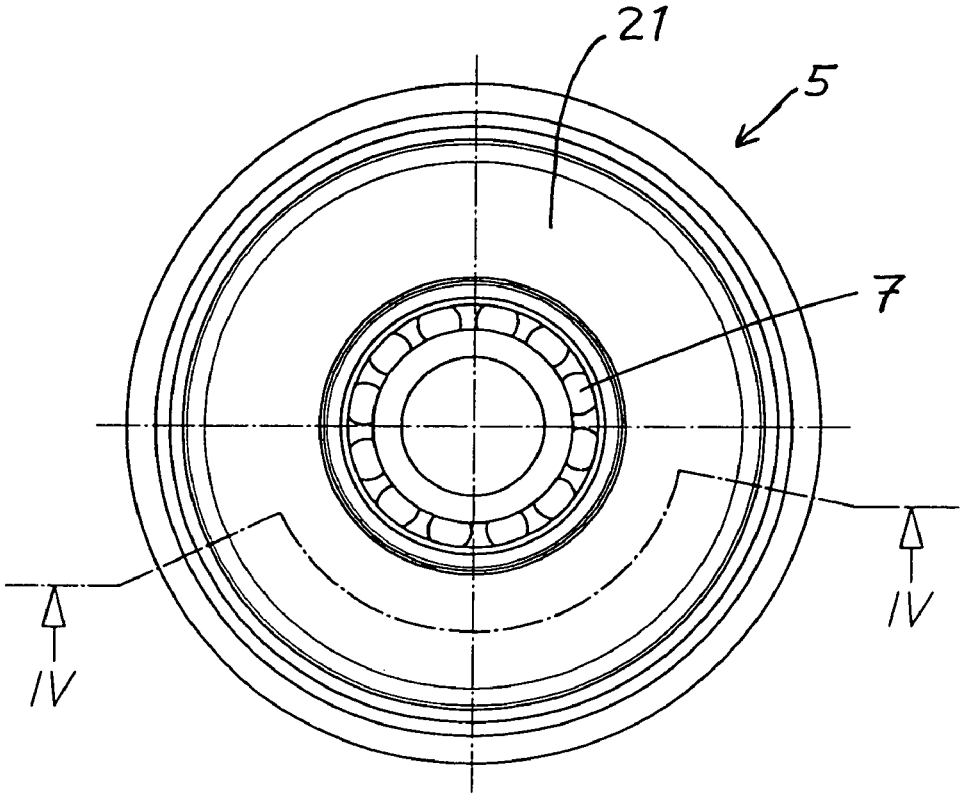
FIG. 3 is a plan view in the axial direction of an embodiment of the height adjustable drive arrangement according to the invention.
Figure 4:
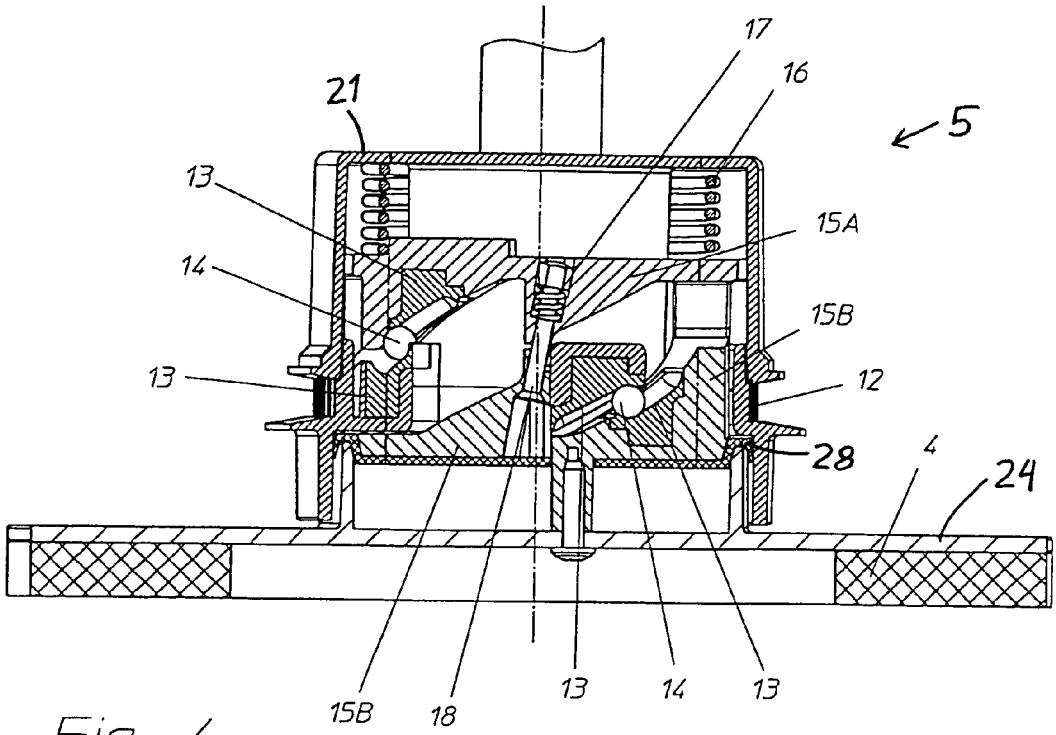
FIG. 4 shows a vertical section along the section line IV-IV shown in FIG. 3, for a retracted or upward position of the driven head and the floor care disc.
Figure 5:
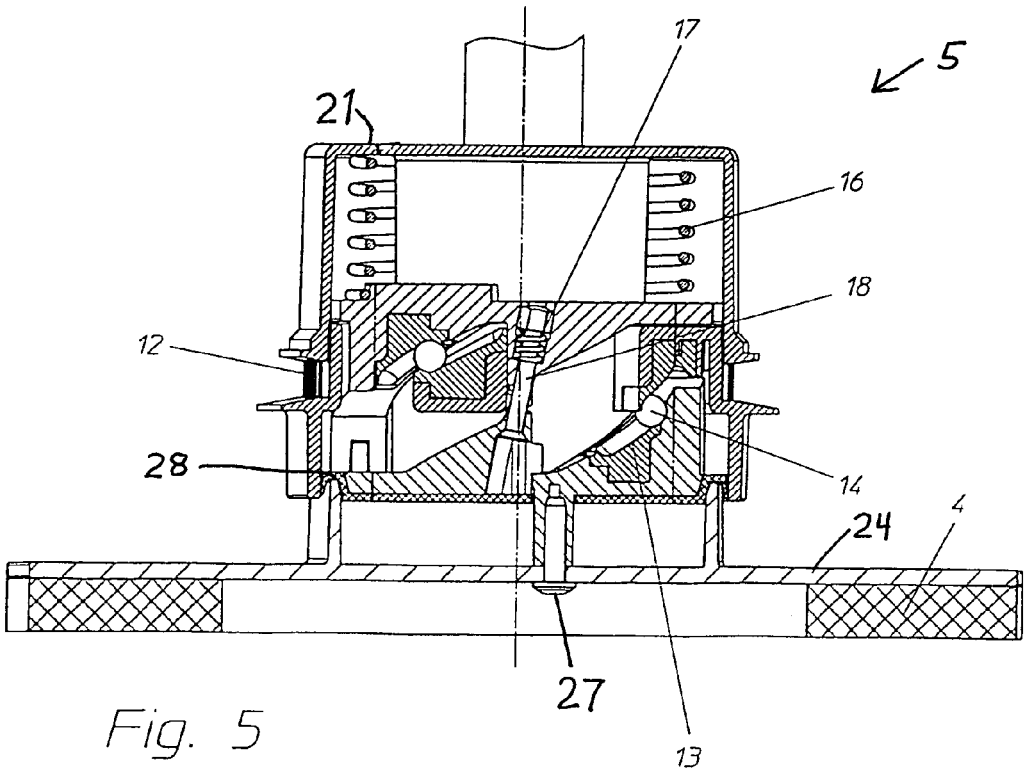
FIG. 5 is a vertical section view similar to that of FIG. 4, but showing the extended or downward position of the driven head and the floor care disc.
Figure 6:
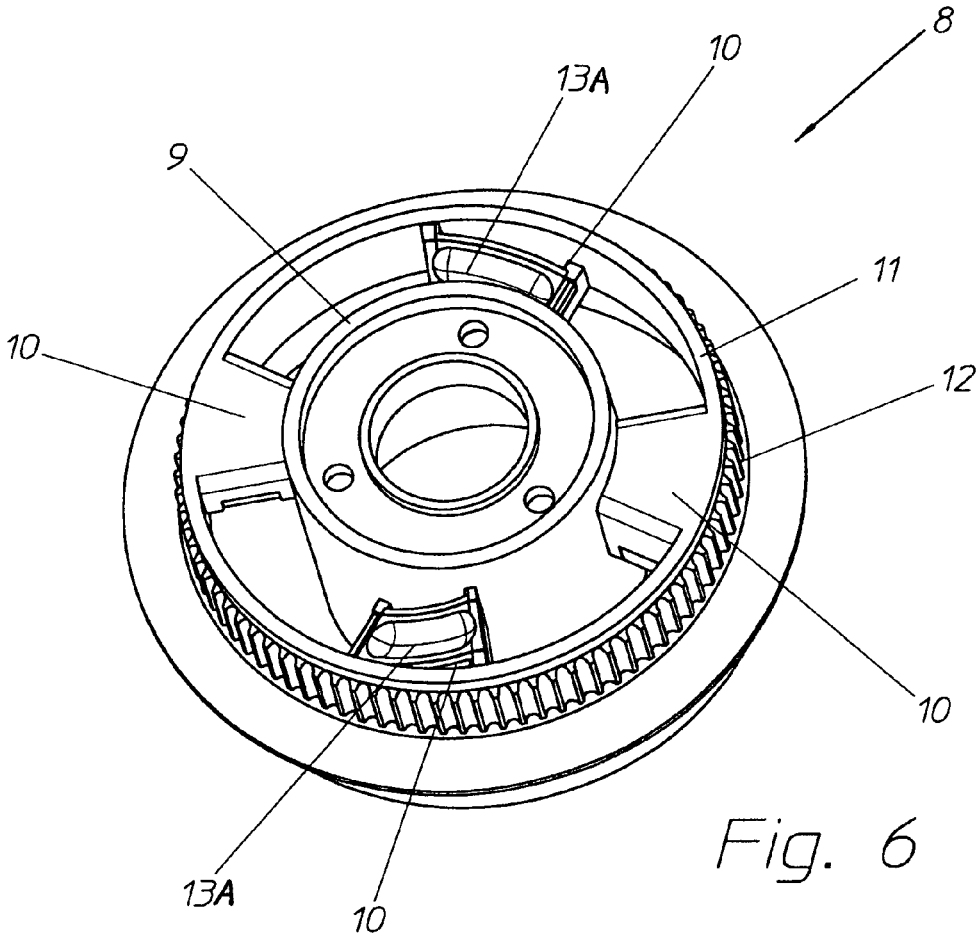
FIG. 6 is a perspective illustration of a drive element of the inventive height adjustable drive arrangement.
Figure 7:
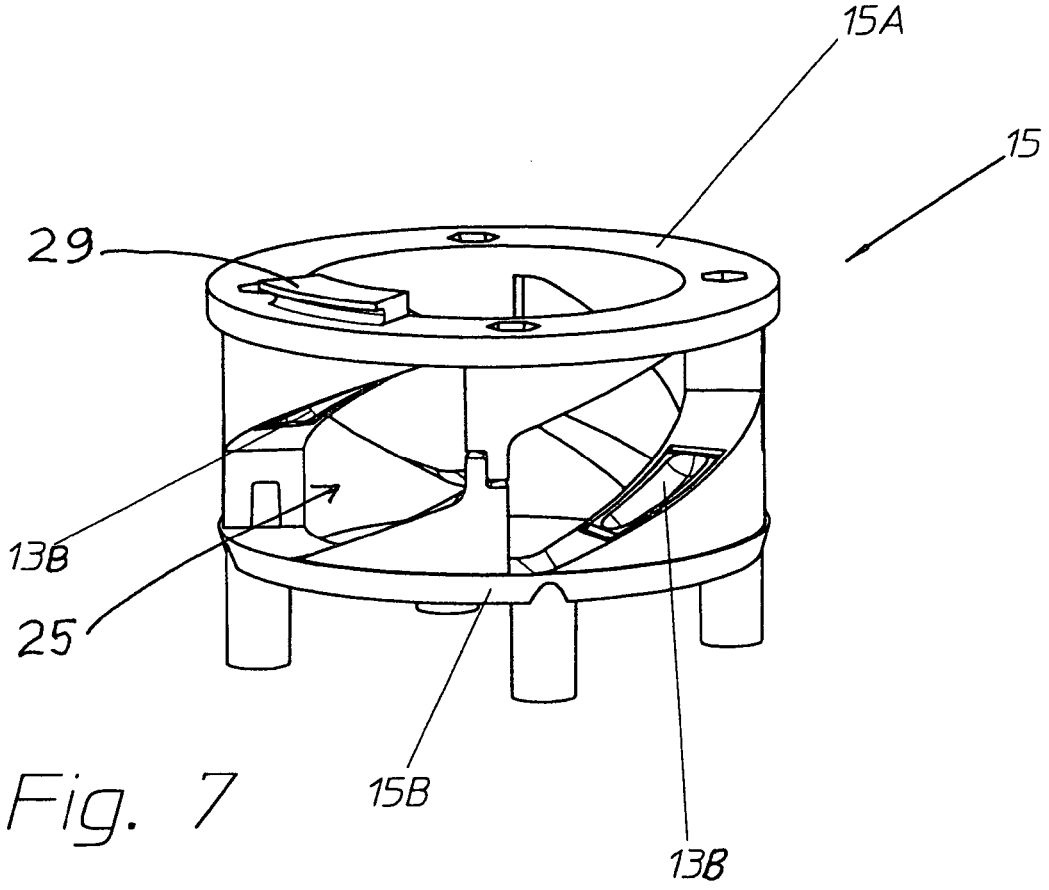
FIG. 7 is a perspective illustration of a two-part driven element of the height adjustable drive arrangement according to the invention.
Figure 8:
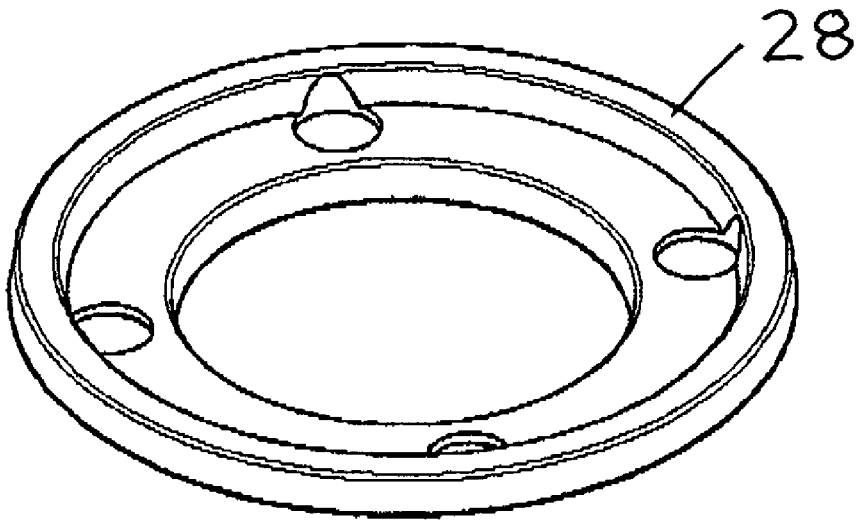
FIG. 8 is a perspective illustration of a seal to be arranged between the drive element and the driven element as shown in FIG. 2.
Figure 9:
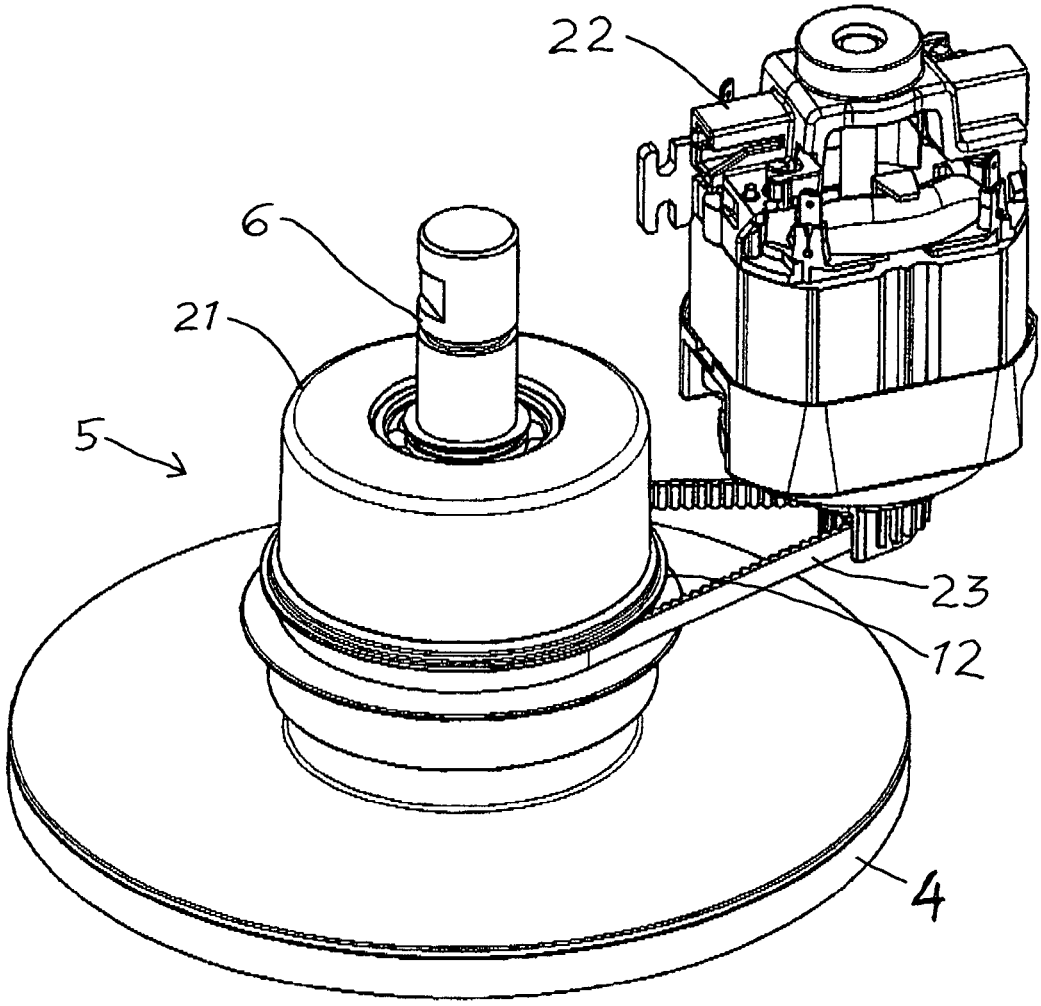
FIG. 9 is a perspective illustration of parts of the floor care machine, including the motor, drive belt, drive arrangement, and floor care disc.

DETAILED DESCRIPTION OF A PREFERRED EXAMPLE EMBODIMENT AND THE BEST MODE OF THE INVENTION

A floor care machine according to the invention is especially embodied as a floor polishing machine in the present example embodiment. This floor care machine comprises a machine frame or chassis 1 that is supported on a floor surface (not shown) by support and guide elements including running rollers or wheels 2 and a centrally located support roller or wheel 3, which roll along the floor surface to allow the machine to be easily moved. Also, the rollers 2 and 3 support an adjustable portion of the weight of the machine on the floor. The machine further includes a rotationally driven head 24 on which a floor care disc 4 such as a floor polishing pad, a floor brush, a floor sanding disc, or the like can be mounted. Still further, the machine includes a drive motor 22 that is operatively coupled for rotational drive transmission through a transmission element, such as a toothed drive belt 23, and through a height adjustable drive arrangement 5 to the driven head 24 and therewith the floor care disc 4.

The height adjustable drive arrangement 5 enables an automatic height adjustment of the floor care disc 4 relative to the support roller 3 and thus relative to the floor surface, while also transmitting the rotational drive from the drive motor 22 to the floor care disc 4. The height adjustment is achieved automatically depending on the torque applied by the motor 22 through the drive arrangement 5 against the working resistance of the floor care disc 4 working against the floor surface. That working resistance varies depending on the type of floor care disc, the characteristics of the floor surface, whether the floor care treatment is carried out with any added floor treatment substance (e.g. a cleaning liquid or a polish), the contact pressure of the floor care disc against the floor surface, and other factors. The contact pressure depends on the height adjustment of the floor care disc 4 relative to the support roller 3.

More particularly, the height adjustment preferably occurs responsive to and dependent on the torque applied by the drive motor 22 to the drive element 8 relative to the driven element 15, which is subjected to a working drag or resistance to rotation by the floor care disc 4 rotating against the floor surface. As the driven head 24 and the floor care disc 4 are height-adjusted downwardly relative to the support and guide elements 2 and 3, of the machine, the contact pressure of the floor care disc 4 on the floor increases, which tends to increase the working resistance and thus increases the torque applied through the drive arrangement 5. On the other hand, when the height of the driven head 24 and the floor care pad 4 is adjusted upwardly, this reduces the contact pressure of the floor care pad on the floor, thereby reducing the working resistance and the torque applied through the drive arrangement 5. Viewed differently, as the working resistance of the floor care disc 4 on the floor increases, thereby the torque applied through the drive arrangement 5 increases, and in response thereto the height of the driven head 24 and the floor care disc 4 will be adjusted upwardly so as to reduce the contact pressure and the working resistance. On the other hand, when the working resistance of the floor care disc 4 on the floor reduces, thereby the applied torque is reduced, and in response thereto the height of the driven head 24 and the floor care disc 4 is adjusted downwardly so as to increase the contact pressure and the working resistance. Thus, it can be seen that the height adjustment is self-regulating dependent on the torque being applied through the drive arrangement, so as to achieve a self-regulating intended or target torque.

The floor care disc 4 is mounted in any known or conceivable suitable manner on the driven head 24, which is rotatably supported via a ball bearing arrangement 7 relative to a stationary spindle or shaft 6 defining a substantially vertical rotation axis 26. In this regard, "substantially vertical" means within the normal range of angular deflections about the true vertical according to a normal working angular range of floor care heads of such floor care machines, for example which may be tilted by several degrees, e.g. up to ±10° or preferably up to ±5° relative to the vertical. The rotationally driven head 24 and the floor care pad 4 are adapted to rotate about the rotation axis 26. The driven head 24 is also supported by the spindle or shaft 6 in the machine frame 1. The driven head may have a disc shape with a relatively large diameter approximately like that of the floor care disc 4, or it may be a disc with a larger diameter or a smaller diameter than the floor care disc 4, or it may be a central hub, chuck, collet or the like with a relatively small diameter to which the floor care disc is mounted.

The height adjustable drive arrangement 5 includes a drive element 8 operatively coupled to the drive motor 22 via a transmission element (e.g. drive belt 23) engaging a gear rim 12 for example, and a driven element 15 connected, e.g. by bolts 27 or any other suitable securing elements, to the driven head 24. Thus, the drive element 8 is rotationally driven by the drive motor 22, and the driven head 24 rotates together with the driven element 15. The rotational drive torque is transmitted from the drive element 8 to the driven element 15 in the manner and through the construction that will be described below.

The drive element 8 comprises a bearing hub 9 that is rotatably supported on the shaft 6 via the ball bearing arrangement 7. The drive element 8 further includes an outer ring 11, and four uniformly rotationally or circumferentially offset spoke elements 10 that connect the outer ring 11 to the bearing hub 9. Namely, in the present example embodiment, the spoke elements 10 are rotationally offset by 90° from one another. An outer portion, for example an outer circumferential surface, of the outer ring 11 is provided with a gear rim or ring gear 12 adapted to be engaged by a transmission element such as toothed gear belt 23 driven by the drive motor 22 so as to transmit the drive power from the drive motor 22 to the outer ring 11. Alternatively, the drive transmission can be achieved through a V-belt and a smooth belt pulley or sheave on the outer ring 11, or via coupled mechanical gears, or via a drive shaft, or the like.

The spoke elements 10 respectively carry first rolling guides 13A adapted to support and guide roller bodies 14 rollingly therealong as will be described below. The first rolling guides 13A may be formed by guide grooves milled directly into the spoke elements 10, or preferably the rolling guides 13A comprise guide member inserts that are fabricated separately from the spoke elements and are inserted into receiver recesses in the spoke elements. The rotationally successive first rolling guides 13A are arranged with a respective alternating reversed orientation on opposite sides of successive adjacent spoke elements 10. In other words, a given spoke element 10 has its rolling guide 13A facing upwardly and in a clockwise direction, while the next adjacent spoke element 10 has its rolling guide 13A facing downwardly and in a counterclockwise direction. The rolling guides 13A each respectively extend along a partial section of a helical path about the center rotation axis 26, like a partial section of a screw thread path.

The driven element 15 comprises two partial elements 15A and 15B that can be assembled together on the two opposite sides (top and bottom) of the spoke elements 10 of the drive element 8. In other words, the spoke elements 10 are received in radial spaces 25 formed between the two partial elements 15A and 15B when the two partial elements 15A and 15B are assembled together to form the driven element 15. Thus, the drive element 8 is received in and engages with the driven element 15. Bounding the open spaces 25, the partial elements 15A and 15B respectively carry second rolling guides 13B arranged opposite and facing the first rolling guides 13A of the spoke elements 10 to form cooperating pairs of the rolling guides 13A and 13B. Also, roller bodies 14 such as roller balls are respectively inserted between the first rolling guides 13A of the spoke elements 10 and the corresponding paired second rolling guides 13B of the partial elements 15A and 15B of the driven element 15.

The partial elements 15A and 15B of the driven element 15 are connected to one another by securing elements such as screws or bolts 18, preferably in a spring-yielding manner through the interposition of springs 17 on the bolts 18. Thereby, the partial elements 15A and 15B are yieldingly held or clamped together with a spring-biased play while spring-clamping or pre-stressing the roller bodies 14 and the spoke elements 10 therebetween. This coupling of the four spoke elements 10 rotationally offset by 90°, with the correspondingly 90° offset portions of the driven element 15, through the roller bodies 14 interposed between the first and second rolling guides 13A and 13B, forms a Cardanic or universal joint coupling that allows angular deflection of the rotation axis 26 even while this joint arrangement is transmitting the rotation and drive torque therethrough. The springs 17 provide an elastic yielding Cardanic suspension by allowing small yielding movements of the two partial elements 15A and 15B of the driven element 15 relative to one another, while tending to close any play between the partial elements and the spoke elements. The springs 17 also counteract, in a yielding manner, the roller body forces. For this purpose, the securing bolts 18 with the springs 17 thereon are preferably not parallel to the axis 26, but rather are tilted at a skew tilt angle in a direction corresponding to the slope of the helical path of the rolling guides.

The arrangement further comprises a pre-stressing or biasing element, preferably a spring 16 bearing against the upper partial element 15A of the driven element 15 from a housing 21. The spring 16 preferably engages a spring catch 29 on the upper partial element 15A. Thereby, the upper partial element 15A is axially and/or rotationally biased so that it tends to move in a downward direction. Thus, the driven element 15 and the driven head 24 connected thereto are spring-biased by the spring 16 to be driven downwardly relative to the support roller 3, so that the floor care disc 4 is biased toward a maximum protruding position. This spring-biased arrangement of the driven element 15, and the cooperation of the driven element 15 with the drive element 8 via the first and second rolling guides 13A and 13B with the roller bodies 14 received therebetween, form the automatic height adjustable coupling through the drive arrangement. A relative rotation between the drive element 8 and the driven element 15 will be translated into an axial shifting and height adjustment of the driven element 15 and the driven head 24 along the rotation axis 26. When a relatively higher torque is applied via the drive element 8 against the working resistance of the floor care disc 4 feeding back through the driven head 24 and the driven element 15, then the spoke elements 10 will shift farther clockwise (as seen from the top, for a clockwise rotation drive) relative to the drive element 15, due to the applied drive torque. That will push the upper partial element 15A upwardly against the biasing force of the spring 16. This upward shifting of the driven element 15 will correspondingly adjust the height of the driven head 24 upwardly, which will tend to reduce the working resistance of the floor care disc 4 working against the floor surface. That in turn will tend to reduce the torque being transmitted through the drive arrangement 5, so that the biasing spring 16 will tend to shift the driven element 15 downwardly again. Thus, the drive arrangement 5 establishes a self-regulation of the torque, and especially an automatic regulation of the height of the floor care disc 4 relative to the support roller 3 in response to and dependent on the torque being applied through the drive arrangement 5.

The helical twist direction of the helical path of the rolling guides 13 is selected depending on the direction of rotation of the drive arrangement, so that as drive torque is applied from the drive element 8 through the rolling guides 13 and the roller bodies 14 to the driven element 15, the helical slope will generate an axial reactive force that tends to push the driven element 15 upwardly against the biasing force of the biasing spring 16. The biasing force of the biasing spring and the helical slope angle of the helical path of the rolling guides are selected in cooperation with one another to achieve the intended target torque through the drive arrangement 5 in a self-regulating manner.

A flexible seal 28 is preferably arranged between the drive element 8 and the driven element 15, so as to seal the drive arrangement 5 against the penetration of dirt, dust, floor care or treatment liquids such as cleaners and polishes, and the like. The seal 28 is movable and flexible to allow the relative axial and rotational movement of the drive element 8 and the driven element 15 relative to each other. The seal 28 may be made of rubber or a polymer, for example.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A floor care machine comprising:

a machine frame;

a drive motor mounted on said machine frame;

support elements connected to said machine frame and adapted to at least partially support said floor care machine on a floor surface such that said floor care machine can be moved along the floor surface;

a driven head that is rotatably carried relative to said machine frame to be rotatable about a rotation axis, and that is adapted to carry a floor care disc on a bottom of said driven head facing the floor surface; and a drive arrangement that couples said drive motor to said driven head so as to rotationally drive said driven head and enable a height adjustment of said driven head relative to at least one of said support elements so as to adjust a contact pressure of the floor care disc on the floor surface;

wherein:

said drive arrangement includes a drive element that is rotatably supported so as to be rotatable about said rotation axis, a drive transmission that couples said drive motor to said drive element for rotation with said drive motor, and a driven element that is rotatable about said rotation axis and is coupled to said drive element so that said driven element is rotationally and axially displaceable relative to said drive element about and along said rotation axis;

said drive element comprises a central hub, an outer ring that is engaged by said drive transmission, and a plurality of spoke elements that are uniformly rotationally offset from one another and that extend between and interconnect said central hub and said outer ring;

said spoke elements respectively have respective first rolling guides that respectively extend along respective partial helical paths about said rotation axis;

said driven element comprises first and second partial elements that are arranged on two axially opposite sides of said spoke elements and are connected to one another;

said partial elements of said driven element have second rolling guides that respectively extend along said respective partial helical paths, and that respectively face toward and form respective pairs with said first rolling guides; and said drive arrangement further includes plural roller bodies that are respectively interposed between, and are configured and fitted to roll guidedly along, said pairs of said first and second rolling guides.

2. The floor care machine according to claim 1, wherein said plural spoke elements comprise at least four of said spoke elements, and wherein successive ones of said first rolling guides on rotationally successive ones of said spoke elements are respectively oriented facing successively oppositely relative to one another.

3. The floor care machine according to claim 2, wherein said first rolling guides are provided circumferentially intermittently on respective opposite facing sides of said successive ones of said spoke elements.

4. The floor care machine according to claim 1, wherein radial openings of said driven element are bounded between said first and second partial elements of said driven element, and said spoke elements of said drive element are respectively received in said radial openings between said first and second partial elements.

5. The floor care machine according to claim 1, wherein said drive arrangement further includes a biasing spring that axially and/or rotationally biases said driven element to be axially displaced toward the floor surface relative to said drive element.

6. The floor care machine according to claim 1, wherein, through a cooperation of said first and second rolling guides with said roller bodies interposed therebetween, said height adjustment of said driven head is coupled with a rotational displacement of said driven element relative to said drive element about said rotation axis responsive to a torque applied from said drive element onto said driven element through said roller bodies.

7. The floor care machine according to claim 1, wherein said driven element further comprises securing elements that secure said first and second partial elements to one another with a limited play therebetween, and springs arranged to spring-bias said first and second partial elements toward one another so as to tend to close said play between said first and second partial elements.

8. The floor care machine according to claim 7, wherein said springs are respectively arranged on said securing elements so as to bear against said securing elements and one of said partial elements.

9. The floor care machine according to claim 7, wherein said drive arrangement provides a Cardanic coupling of said driven element with said drive element to enable an angular deflection of said rotation axis through said drive arrangement.

10. The floor care machine according to claim 7, wherein said securing elements each respectively extend at a skew tilt angle away from parallel relative to said rotation axis.

11. The floor care machine according to claim 10, wherein said skew tilt angle corresponds to rolling body forces that act from said rolling bodies onto said rolling guides.

12. The floor care machine according to claim 10, wherein said skew tilt angle tilts in a same direction as said partial helical paths about said rotation axis.

13. The floor care machine according to claim 1, wherein said first rolling guides are first rolling guide grooves integrally formed in said spoke elements, and said second rolling guides are second rolling guide grooves integrally formed in said first and second partial elements of said driven element.

14. The floor care machine according to claim 1, wherein said first rolling guides comprise first insert members that are formed of wear-resistant sintered material, and have first rolling guide grooves formed therein, and are received in respective fitting recesses provided in said spoke elements; and wherein said second rolling guides comprise second insert members that are formed of wear-resistant sintered material, and have second rolling guide grooves formed therein, and are received in respective fitting recesses provided in said first and second partial elements of said driven element.

15. The floor care machine according to claim 14, wherein all of said first and second insert members are interchangeable equivalent members that all have the same configuration, dimensions, and material composition as one another.

16. The floor care machine according to claim 1, wherein said drive arrangement further comprises an axially and rotationally movable seal arranged between said drive element and said driven element.

17. The floor care machine according to claim 1, wherein said support elements include two running wheels or rollers arranged coaxially with one another at a base edge of said machine frame, and one support wheel or roller arranged protruding below said driven head on said rotation axis of said driven head with a rolling axis of said support wheel or roller extending perpendicularly to said rotation axis of said driven head.

18. A floor care machine comprising:

a machine frame;

a drive motor mounted on said machine frame;

support elements connected to said machine frame and adapted to at least partially support said floor care machine on a floor surface such that said floor care machine can be moved along the floor surface;

a driven head that is rotatably carried relative to said machine frame to be rotatable about a rotation axis, and that is adapted to carry a floor care disc on a bottom of said driven head facing the floor surface; and a drive arrangement that couples said drive motor to said driven head so as to rotationally drive said driven head and enable a height adjustment of said driven head relative to at least one of said support elements so as to adjust a contact pressure of the floor care disc on the floor surface;

wherein:

said drive arrangement includes a drive element that is rotatably supported so as to be rotatable about said rotation axis, a drive transmission that couples said drive motor to said drive element for rotation with said drive motor, and a driven element that is rotatable about said rotation axis and is coupled to said drive element so that said driven element is rotationally and axially displaceable relative to said drive element about and along said rotation axis;

said drive element comprises a central hub, an outer ring that is engaged by said drive transmission, and at least four spoke elements that are uniformly rotationally offset from one another and that extend between and interconnect said central hub and said outer ring;

said spoke elements respectively have respective first rolling guides that respectively extend along respective partial helical paths about said rotation axis, wherein successive ones of said first rolling guides on rotationally successive ones of said spoke elements are respectively oriented facing successively oppositely relative to one another;

said driven element comprises first and second partial elements that are arranged on two axially opposite sides of said spoke elements and are connected to one another;

said partial elements of said driven element have second rolling guides that respectively extend along said respective partial helical paths, and that respectively face toward and form respective pairs with said first rolling guides;

said drive arrangement further includes plural roller bodies that are respectively interposed between, and are configured and fitted to roll guidedly along, said pairs of said first and second rolling guides; and said drive arrangement further includes a biasing spring that axially and/or rotationally biases said driven element to be axially displaced toward the floor surface relative to said drive element.

19. A floor care machine comprising:

a machine frame;

a drive motor mounted on said machine frame;

support elements connected to said machine frame and adapted to at least partially support said floor care machine on a floor surface such that said floor care machine can be moved along the floor surface;

a driven head that is rotatably carried by said machine frame to be rotatable about a rotation axis, and that is adapted to carry a floor care disc on a bottom of said driven head facing the floor surface; and a drive arrangement that couples said drive motor to said driven head so as to rotationally drive said driven head and enable a height adjustment of said driven head relative to at least one of said support elements so as to adjust a contact pressure of the floor care disc on the floor surface;

wherein:

said drive arrangement includes a drive element that is rotatably supported so as to be rotatable about said rotation axis, a drive transmission that couples said drive motor to said drive element for rotation with said drive motor, and a driven element that is rotatable about said rotation axis and is coupled to said drive element so that said driven element is rotationally and axially displaceable relative to said drive element about and along said rotation axis;

said drive element comprises a central hub, an outer ring that is engaged by said drive transmission, and a plurality of spoke elements that are uniformly rotationally offset from one another and that extend between and interconnect said central hub and said outer ring;

said spoke elements respectively have respective first rolling guides that respectively extend along respective partial helical paths about said rotation axis;

said driven element comprises first and second partial elements that are arranged on two axially opposite sides of said spoke elements and are connected to one another;

said partial elements of said driven element have second rolling guides that respectively extend along said respective partial helical paths, and that respectively face toward and form respective pairs with said first rolling guides;

said drive arrangement further includes plural roller bodies that are respectively interposed between, and are configured and fitted to roll guidedly along, said pairs of said first and second rolling guides; and said driven element further comprises securing elements that secure said first and second partial elements to one another with a limited play therebetween, and springs arranged to spring-bias said first and second partial elements toward one another so as to tend to close said play between said first and second partial elements.

* * * * *